United States Patent [19]

Brown

[11] 4,204,682

[45] May 27, 1980

[54] METHOD AND APPARATUS FOR OUTDOOR TOSSING GAME

[76] Inventor: Floyd E. Brown, 218 7th St., Wood River, Ill. 62095

[21] Appl. No.: 850,158

[22] Filed: Nov. 10, 1977

[51] Int. Cl.[2] ..... A63B 65/10; A63B 67/06; A63B 57/00

[52] U.S. Cl. ..... 273/401; 273/34 B; 273/425

[58] Field of Search ..... 273/95 R, 34 B, 106 B, 273/106 C, 100

[56] References Cited

U.S. PATENT DOCUMENTS

| | | | |
|---|---|---|---|
| 3,363,899 | 1/1968 | Gross | 273/95 R |
| 3,403,907 | 10/1968 | Keller | 273/95 R |
| 3,731,930 | 5/1973 | Jeandron | 273/106 B |
| 3,870,301 | 3/1975 | Brisendine | 273/34 B |

*Primary Examiner*—George J. Marlo
*Attorney, Agent, or Firm*—Rogers, Eilers & Howell

[57] ABSTRACT

A method of playing a game has a plurality of groups of distinguishably identified markers which are tossed from behind a throwing line at a receptacle in an attempt to put the marker in the receptacle. The receptacle is recessed into the ground or other playing surface and is approximately thirty feet to fifty feet away from the throwing line, which may be another receptacle. A protective cover may be provided to enclose the receptacle when not in use to avoid any accidents or the accumulation of contamination therein. The marker may be shaped as a disc or washer and may be sufficiently heavy to be substantially unaffected by all but the strongest wind during play.

The game is played by the method of choosing teams, distributing the markers amongst each team, and then alternately tossing the markers from behind the throwing line at the receptacle until all of the markers have been thrown. The play is then scored by using a series of rules which award a first fixed number of points for each marker which lands in the receptacle, a second fixed number of points for each marker which overhangs the edge of the receptacle, and a third fixed number of points for each marker that is relatively closer to the receptacle than the corresponding markers of each of the other teams, depending upon whether a throw places a marker in the receptacle or an overhang has been thrown. The winning team may be determined by either the first team to accumulate a predetermined number of points, or the team having accumulated the most points after the lapse of a predetermined amount of time.

10 Claims, 5 Drawing Figures

22
23
24
25
26
28
30
32
2

METHOD AND APPARATUS FOR OUTDOOR TOSSING GAME

BACKGROUND AND SUMMARY

There are many types of games currently available for outdoor or backyard play. Some of these use various types of targets with arrow-like devices which are thrown at the targets. However, these types of games are limited in their playability as it is virtually impossible to control the path of the arrow in a brisk wind. Also, these arrows have points so that they stick in the ground to help indicate their position in relationship to the target. This creates an element of danger as it is very easy to misjudge the flight of an arrow or for a player to become careless and hit another player.

Another problem that other games have is that the scoring possibilities are limited by the structure included in the game and the players lose interest rather quickly.

Applicant has succeeded in developing a game which can be played in the outdoors or in the backyard, which overcomes the problems of the prior art and also introduces new benefits which were heretofore unavailable. Applicant's game provides a maximum of enjoyment with just enough complexity in scoring to retain the interest of even the more demanding players. The game may be played by two or more people, either individually or divided up into separate teams. The game can be played until one team achieves a winning total of points which is predetermined before the game is begun or the winning team can be selected by having the most number of points after a predetermined amount of time has passed.

The equipment required for the game includes one or two receptacles or cups which are to be recessed into a playing surface or into the ground so that the top edge of the cup is flush with the playing surface or ground. Although only one cup may be used, it is generally preferred that two cups are used and spaced approximately thirty to fifty feet apart depending upon the space limitations of the playing area. In addition to the cups, two or more groups of markers are provided and are distinguishably identified so that they can be thrown at random and later matched to a particular player or team. These markers may take the shape of a steel or other metal washer or disc approximately three and a half inches in diameter and three sixteenth inches in thickness. The discs may have holes in the centers of approximately one and one half inches in diameter and may be coated with a protective layer of plastic, vinyl, neoprene or any other type of material to resist the abrasion encountered during play and exposure to the elements.

The game is played by choosing up teams and handing out the markers to each team which then divides them up among the team members. If two cups are used, then team members from each team go behind each of the cups. If two cups are used, only one half of each of the teams has possession of the markers when play begins. Play is begun by deciding which team goes first and then having one team member throw a marker at the cup in an attempt to place it in the cup. A score is evident as there is a distinctive sound when the marker lands in the cup. After the first player tosses a marker, each other team takes a turn and play is alternated until all the markers have been tossed.

The tosses are then scored by a predetermined set of rules which may be varied to suit the preference of the players. Applicant has suggested scoring rules which provide maximum enjoyment with a wide variability in scoring possibilities. A marker in the cup is scored at 10 points, a marker hanging over the edge of the cup is scored at 5 points, and one or more points may be awarded for a marker which is closest to the cup, as can be understood more fully from the description of the preferred embodiment.

As is evident, there are many variations in play as well as scoring which add to the versatility of the game and increase the enjoyment beyond that possible with other lawn games or backyard games. Furthermore, the weight of the marker minimizes the effect that wind will have on its toss and therefore the game can be played in almost any sort of weather condition. Lastly, the unique and distinctive noise made by the marker as it lands in the cup gives a player an immediate indication of success and is also a source of humor in itself.

A protective cover may be provided for enclosing the cups after play has ceased to protect the opening from the accumulation of contamination or water as well as to avoid twisting an ankle or otherwise stumbling over the hole. In addition, a toughened playing surface may be provided to surround the cup and ensure accurate bouncing of the marker in the area of the cup. This surface may be made of any sort of plastic or lightweight metal and may be either slick or rough depending upon the desired playability of the marker.

Other benefits and features are included in the brief description of drawings and detailed description of the preferred embodiment following.

DETAILED DESCRIPTION OF THE PREFERRED EMBODIMENT

Figures 1, 2, 3, 4, 5:
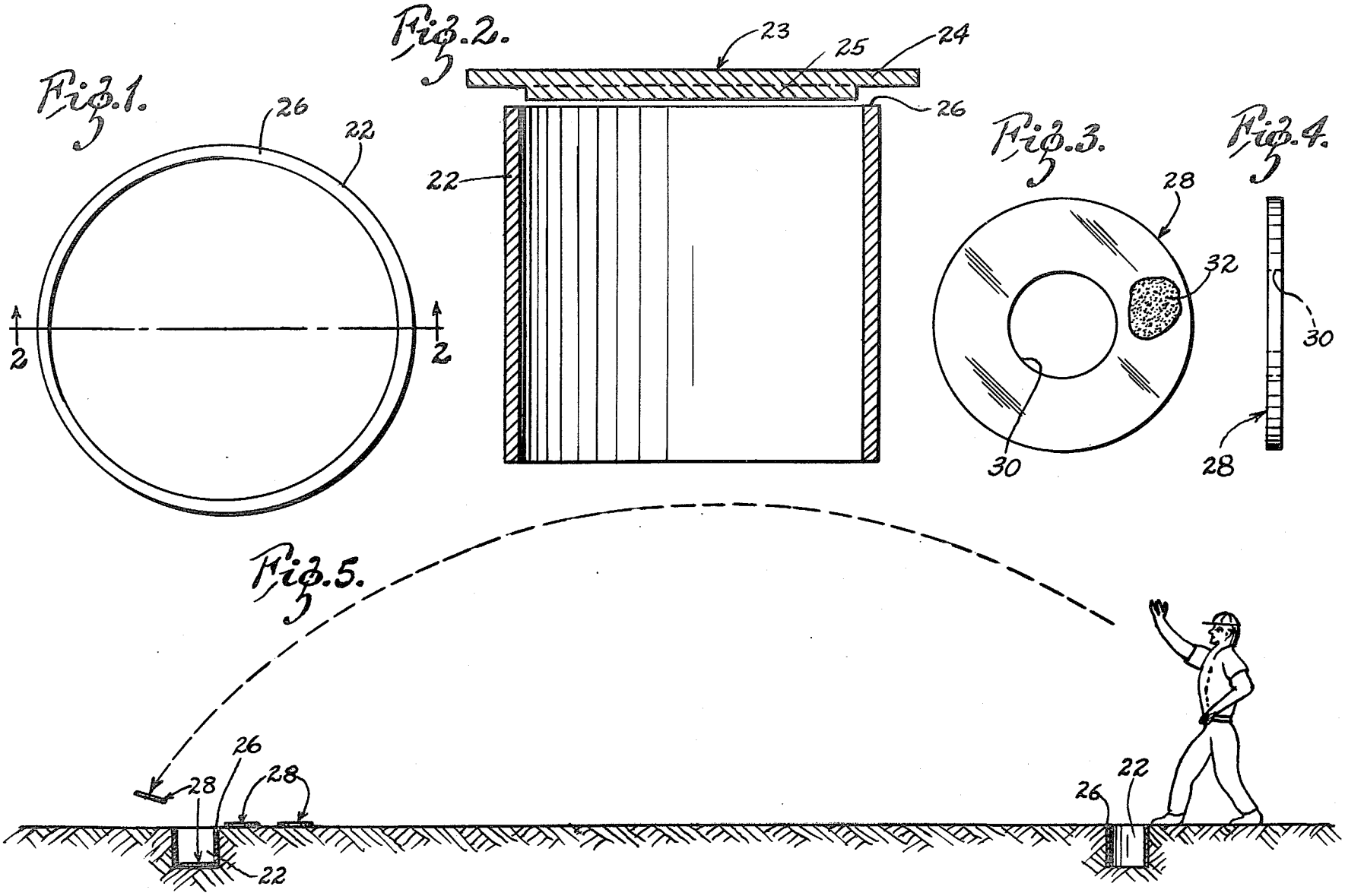
FIG. 1 is a top plan view of the receptacle or cup.
FIG. 2 is a section view of FIG. 1 taken along the line 2—2 and depicts the cup or receptacle and its protective cover.
FIG. 3 is a plan view of a marker.
FIG. 4 is a side view of a marker.
FIG. 5 is a side representational view depicting the play of the game.

Applicant's game includes as part of its equipment a scoring cup or receptacle 22 which may be approximately four and one half inches in diameter and four and one half inches in depth and constructed out of any high impact plastic or lightweight metal such as aluminum. Although the cup 22 does not have a bottom in applicant's preferred embodiment, a bottom may be provided as desired. A protective cover 23 may be provided to fit over the cup 22 when it is not being used to prevent passersby from stepping into the cup and injuring themselves and to prevent the accumulation of water or contamination which would detract from the playing of the game. The protective cover 23 may have a cylindrical cap 24 which is round with a diameter slightly larger than the diameter of the cup 22. An inner flange 25 may be round and extend downwardly from the bottom of the cylindrical cap 24 with a diameter slightly less than that of the cover 23. The protective cover 23 will then fit snugly onto the cup 22 as the bottom surface of the cylindrical cap 24 which is not covered by the inner flange 25 will rest on top the upper edge 26 of the cup 22 and the inner flange will extend into the hollow area of the cup 22 to prevent the cover 23 from being removed by a mere sliding force which is parallel to the top surface 26. Thus, a person stepping on the cover 23 will not be in danger of sliding the cover 23 out of position which may cause him to fall. One or more receptacles or cups 22 may be provided for use in the game. The cups 22 are made ready for play by recessing them into the ground so that the top edge or lip 26 is approximately flush with the surrounding surface. Any type of surrounding surface may be provided such as concrete, plastic sheeting, or merely dirt. Different surrounding surfaces provide a different playability in the game and may be used as desired by the players.

A number of markers 28 are provided as shown in FIGS. 3 and 4 and may be constructed of any relatively heavy metal or combination of materials which provides a good feel for throwing in addition to avoiding the effects of the wind during play. The marker 28 may be approximately three and one half inches in diameter with a one and one inch diameter hole 30 and approximately three sixteenth inches in thickness. A protective coating 32 may be provided and may consist of any baked on enamel, plastic, or vinyl material as desired. In addition, it is desirable that the markers be provided in groups which are distinguishably identified to aid in scoring them after they have been tossed. This can be a distinctive marking with different colors or patterns in the protective coating 32 or any other alternate means as is known in the art. The central hole 30 in the marker 28 makes it easier to handle and hold in the hand in preparation for being tossed. Thus, the level of skill which is attainable in tossing the marker 28 is increased by the players' ability to grasp and toss the marker 28 in the same manner during successive plays.

The game may be played as follows. First of all, the players must divide themselves up into teams, the number of teams to match the number of different kinds of markers 28 available for play. However, the number of teams may be multiplyed by the number of cups 22 being used as will be explained more fully hereinafter. Next, the groups of markers 28 should be passed out to each of the teams and, presuming that there are two cups 22, the markers 28 should be distributed approximately equally amongst one half of each team. Next, a throwing line should be determined behind which each player must stand as he tosses his marker 28. Normally, the cup 22 itself can be used and the players forced to remain behind the closest cup 22 as they attempt to throw a marker 28 at the farthest cup 22. This is depicted in FIG. 5. After the order of play is determined by any random chance means, such as throwing a die, the half of each team having the markers 28 should begin play by a member from the first team throwing a marker 28 from behind the throwing line in an attempt to put the marker 28 into the cup 22. After his toss, a member from another team should throw a marker 28 in a similar fashion. Play should then alternate from team to team until all of the markers 28 have been thrown at the far cup 22. After the last marker 28 has been thrown, the play can be scored by using various types of rules or combinations thereof. Applicant has found that the following rules provide great variability in scoring and an exciting game.

As the play is scored after the last marker 28 has been thrown, it is possible to knock other markers 28 with a well thrown marker 28 to either eliminate another team's hanger or to bump your own marker 28 into the cup 22 or in overhang position.

The score is computed by awarding a fixed number of points times the top marker 28 thrown in the cup 22 and each marker 28 immediately thereunder of the top marker 28 which is from the same team. An intervening marker 28 from a different team will eliminate any other markers 28 beneath it from scoring during that play. This rule provides a great deal of excitement during play in that one team may throw as many markers 28 as it has into the cup 22 and yet not score if a subsequent throw by another team lands on top of these markers 28 and cancels their effectiveness in scoring. This can be particularly frustrating to the first team while at the same time being a windfall to the second team.

The next scoring rule that applicant uses and finds to be exciting is to award a second fixed number of points for each marker 28 which overhangs the top edge 26 of the cup 22. To score, at least some portion of the marker 28 should actually be over the hole area and beyond the top area 26 of the edge of the cup 22. It is possible for a number of markers 28 to score under this rule due to the wide mouth of the cup 22 in comparison with the small amount of marker 28 which must overhang.

A third scoring rule may actually be played in various different ways depending upon the lie of the markers 28 after being tossed. If there is at least one marker 28 that has landed in the cup 22 or in a hanger position, and as a result scores under the first two rules, then it may be desirable to score just one other marker 28. Therefore, a reduced score of a third fixed number of points may be awarded to only one marker 28 that is the closest one to the center of the cup 22. However, if there are no markers 28 that score under the first two scoring rules, then it may be desirable to score more points under the third scoring rule. This can be done by matching up the markers 28 between teams' in their order of relative distance from the center of the cup 22. A third fixed number of points may then be awarded to each marker 28 that is closer to the cup 22 than those in its corresponding grouping of other teams markers 28. As an example, if each team has four markers 28 and there are no markers 28 thrown in the cup 22 or in an overhang position, and all of one team's markers 28 are closer to the cup 22 than the other team's markers 28, then the team having the closer markers 28 may be allowed to score four times the third fixed number of points being awarded under rule 3. However, with the same lie except that one of the teams has thrown a marker into the cup 22 or an overhang position, than only one times the third fixed number of points may be awarded to the team having the four closest markers 28. Thus there is a high reward for a team throwing a marker 28 into the cup 22 or overhang position as it normally serves to cancel out a portion of an opposing teams possible score in addition to scoring positive points for the scoring team. This is a double reward increasing the excitement of play and allowing an underdog team to rapidly overcome a seeming insurmountable lead. It should be noted that there are numerous variations which can be made in the third scoring rule which can be used as shortcuts to avoid controversy during play and hasten play along a faster pace.

After the play has been scored, the second half of each team then collects the markers 28 and resumes play by tossing them back at the first cup 22 from behind their throwing line. To increase the capacity for players, new teams may be formed and participate by throwing the markers 28 at this point of the game instead of the second half of each team. Thus, two teams may play for each group of markers 28 if there are two cups 22. In fact, the team capability in general is equal to the number of groups of markers 28 times the number of cups 22.

A winning team may be declared in one of several ways. A predetermined number of points may be chosen as the goal and the first team to reach the goal becomes the winning team. A tie score may be decided by continuing play for as many complete tosses as required until one team moves ahead. A second criteria may be the team with the most number of points after a predetermined amount of time has elapsed. Tie scores may be resolved in a similar manner. Other rules may be used to decide the winning team and is limited only by the imagination of the players.

There may be changes and modifications which could be made to applicant's invention by one of ordinary skill in the art and which is included in the scope of applicant's invention. Applicant intends that his invention be limited only by the scope of the claims appended hereto.

I claim:

1. A method of playing a game for two or more teams of players, the game having a receptacle recessed into a playing surface and a plurality of groups of markers of sufficient weight to be substantially unaffected when tossed in a wind, each of said groups having means to be distinguishably identifiable from the other groups, the method comprising the steps of:

(a1) assigning each team of players a group of markers, (b1) determining the order of team play by any suitable random chance means, (c1) choosing a throwing line behind which a player must stand while throwing a marker, (d1) playing by a member from the first team throwing a marker from behind the throwing line and attempting to put the marker into the receptacle, (e1) alternating play from team to team until all markers have been played, (f1) scoring play by awarding points computed by multiplying the last marker thrown into the receptacle plus each of the same teams markers immediately thereunder by a first number of points and awarding points computed by multiplying each marker having a portion thereof overhanging the lip of the receptacle by a second number of points, (g1) picking up the markers, (h1) continuing play by repeating steps d1 through g1, (i1) ending play by declaring as the winner the first team to achieve the goal score.

2. The method of claim 1 further comprising the step of deciding the goal score as a certain number of points.

3. The method of claim 1 further comprising the step of deciding the goal score as the most number of points achieved after the lapse of a certain amount of time.

4. The method of claim 1 further comprising a second receptacle recessed into the playing surface a substantial distance from the first receptacle and including the steps of choosing a second throwing line behind which a player must stand while throwing a marker at the second receptacle; positioning approximately half of each team behind each of the throwing lines so that each player throws at only one receptacle during play; distributing the markers approximately equally amongst the team members behind one of the throwing lines; and redistributing the markers by group to each team approximately equally amongst the remaining team members.

5. The method of claim 4 wherein the receptacles have protective covers and including the steps of removing the protective covers from the receptacles, and replacing the protective covers onto the receptacles.

6. The method of claim 1 further comprising the step of awarding a third number of points for the marker having the shortest radial distance from the center of the receptacle if there are no markers in the receptacle or overhanging the receptacle.

7. The method of claim 6 further comprising the step of awarding a third number of points for each marker of one team that is closer to the receptacle than a corresponding marker of another team, each marker being matched with other teams markers in order of relative distance from the cup, if there are markers in the receptacle or overhanging the receptacle.

8. A kit for playing the method of claim 1, said kit having a plurality of groups of markers, each marker being substantially round with flatted opposing sides, means defining a central hole extending between said flatted opposing sides, means forming a covering over substantially all exposed surfaces of the marker, said covering protecting the marker from substantial damage during extended use, and said marker being sufficiently heavy in relation to its mass to substantially minimize the effects of the wind on its flight as it is tossed; a receptacle suitable for being recessed flush into a substantially flat playing surface and receiving a thrown marker, said receptacle having a substantially cylindrical sidewall with an upper and lower edge, said edges being substantially parallel and each edge forming a surface substantially perpendicular to the central axis of the receptacle with a diameter sufficiently larger than the diameter of the marker to permit relatively frequent tossing of the marker into the receptacle from a substantial distance therefrom, said receptacle having a depth sufficient to accept a substantial number of markers positioned therein with their flatted surfaces aligned substantially parallel to the top and bottom edges of the sidewalls.

9. The kit of claim 8 further comprising a protective cover for covering the opening of the receptacle after it is recessed into a playing surface to prevent the entry of contamination thereinto and for safety purposes having a cylindrical cap, said cylindrical cap having a top and bottom surface approximately circular with a diameter larger than the diameter of the receptacle and an inner flange being approximately cylindrical in shape with a diameter less than that of the receptacle, said inner flange being centered on and extending downwardly from the bottom surface of the cylindrical cap, the protective cover thereby fitting onto the upper opening in the receptacle with the bottom surface of the cylindrical cap adjacent to and flush with the upper surface of the edge of the receptacle and the inner flange extending downwardly into the hollow area of the receptacle to prevent removal of the protective cover by sliding movement substantially parallel to the top surface thereof.

10. A kit for playing a game including a plurality of groups of metal markers, each marker being substantially round with flatted opposing sides, means defining a central hole extending between said flatted opposing sides, means forming a covering over substantially all exposed surfaces of the marker, said covering being made of plastic and protecting the marker from substantial damage during extended use, said marker being sufficiently heavy in relation to its size to substantially minimize the effects of the wind on its flight as it is tossed, a receptacle suitable for being recessed flush into a substantially flat playing surface and receiving said markers as they are thrown, said receptacle having a substantially cylindrical sidewall with an upper and lower edge, said edges being substantially parallel and each edge forming a surface substantially perpendicular to the central axis of the receptacle with a diameter sufficiently larger than the diameter of the marker to permit relatively frequent tossing of the marker into the receptacle from a substantial distance therefrom, said receptacle having a depth sufficient to accept a substantial number of markers positioned therein with their flatted surfaces aligned substantially parallel to the top and bottom edges of the sidewalls, a protective cover for covering the opening of the receptacle after it is recessed into a playing surface to prevent the entry of contamination thereinto and for safety purposes, said protective cover including a cylindrical cap having a top and bottom surface approximately circular with a diameter larger than the diameter of the receptacle and an inner flange being approximately cylindrical in shape with a diameter of less than that of the receptacle, said inner flange being centered on and extending downwardly from the bottom surface of the cylindrical cap, the protective cover thereby fitting on to the upper opening in the receptacle with the bottom surface of the cylindrical cap adjacent to the upper surface of the edge of the receptacle and the inner flange extending downwardly into the hollow area of the receptacle to prevent removal of the protective cover by sliding movement substantially parallel to the top surface thereof.

* * * * *